US006717341B1

(12) United States Patent
Matsuba et al.

(10) Patent No.: US 6,717,341 B1
(45) Date of Patent: Apr. 6, 2004

(54) BULB-FORM LAMP AND ITS MANUFACTURING METHOD

(75) Inventors: Tetsuo Matsuba, Neyagawa (JP); Shinichiro Ishitsuka, Osaka (JP); Takenori Shibata, Takatsuki (JP); Takeshi Matsumura, Kashiwara (JP)

(73) Assignee: Matsushita Electric Industrial Co., Ltd. (JP)

( * ) Notice: Subject to any disclaimer, the term of this patent is extended or adjusted under 35 U.S.C. 154(b) by 465 days.

(21) Appl. No.: 09/651,590

(22) Filed: Aug. 30, 2000

(30) Foreign Application Priority Data

Sep. 3, 1999 (JP) ..... 11-250018

(51) Int. Cl.[7] ..... H01J 5/48
(52) U.S. Cl. ..... 313/318.01; 313/318
(58) Field of Search ..... 313/318.01, 318, 313/318.04, 318.12; 315/58, 71, 194; 362/221; 437/615, 226, 611, 613, 236, 302

(56) References Cited

U.S. PATENT DOCUMENTS

| | | | | |
|---|---|---|---|---|
| 3,551,736 A | | 12/1970 | Doehoer | 315/100 |
| 4,570,105 A | | 2/1986 | Engel | 315/58 |
| 4,695,767 A | | 9/1987 | Wittmann | 315/58 |
| 4,999,538 A | * | 3/1991 | Lapre et al. | 313/318 |
| 5,731,663 A | * | 3/1998 | Davis | 315/194 |

FOREIGN PATENT DOCUMENTS

| | | |
|---|---|---|
| DE | 254462 A1 | 2/1988 |
| DE | 265 027 A1 | 2/1989 |
| DE | 195 09 112 A1 | 9/1996 |
| DE | 195 34 245 A1 | 3/1997 |
| EP | 0 480 503 A1 | 9/1991 |

* cited by examiner

*Primary Examiner*—Nimeshkumar D. Patel
*Assistant Examiner*—K A Berck
(74) *Attorney, Agent, or Firm*—Parkhurst & Wendel, L.L.P.

(57) ABSTRACT

A bulb-form lamp allows a lighting circuit and an eyelet to be easily and reliably connected together without using any soldering or plasma arc welding or lead wires, prevents a lighting failure caused by an inappropriate contact, and reduces costs while improving productive efficiency. A case having a lighting circuit accommodated inside includes a base formed at an end portion thereof and having an eyelet and a screw-like shell. The lighting circuit and the eyelet are connected together without any lead wire.

10 Claims, 3 Drawing Sheets

BULB-FORM LAMP AND ITS MANUFACTURING METHOD

FIELD OF THE INVENTION

The present invention relates to a bulb-form lamp and its manufacturing method.

BACKGROUND OF THE INVENTION

In a conventional bulb-form lamp, for example, a bulb-form fluorescent lamp, an enclosure 15 comprising a globe 1 and a case 14 has accommodated therein a fluorescent tube 4, a lighting circuit 16 for lighting the fluorescent tube 4, and two lead wires 17*a* and 17*b* connected to the lighting circuit 16 to supply power, as shown in FIG. 4.

The case 14 has a base 18 screwed at an end portion thereof.

The lighting circuit 16 has a lighting part 16*b* mounted on a printed circuit board 16*a*. The printed circuit board 16*a* is located inside the case 14 perpendicularly to a center axis thereof.

The base 18 has a screw-like shell 18*a* and an eyelet 18*c* provided at an end portion of the shell 18*a* via an insulator 18*b* comprising glass.

Individual parts of the shell 18*a* and eyelet 18*c* are embedded in the insulator 18*b* to integrate the shell 18*a*, the insulator 18*b*, and the eyelet 18*c* together.

One 17*a* of the lead wires is soldered outside the base 18, that is, to an outer surface of the eyelet 18*c*. Alternatively, the lead wire 17*a* and the eyelet 18*c* are connected together by means of plasma arc welding for environmental reasons.

A method for manufacturing this conventional bulb-form lamp will be described below.

A normal method is used to assemble together the enclosure 15, the fluorescent tube 4, and the lighting circuit 16 having the lead wires 17*a* and 17*b* connected thereto. Subsequently, the base 18 is screwed on an end portion of the case 14 and then caulked and fixed to the case 14. In this case, the lead wire 17*a* is led out from a through-hole 18*d* formed in the eyelet 18*c*. The led-out portion of the lead wire 17*a* is fixedly soldered to an outer surface of the eyelet 18*c*.

In this conventional bulb-form lamp, however, since the lighting circuit 16 and the eyelet 18*c* are connected together by means of the lead wire 17*a*, material costs of the lead wire 17*a* are high and a large amount of time and labor is required to connect the lead wire 17*a* to the lighting circuit 16 and the eyelet 18*c*, thereby reducing productivity and increasing costs.

In addition, if the lead wire 17*a* of the conventional bulb-frame lamp is connectedly soldered to the eyelet 18*c*, a flux (a resin or the like) used for the soldering is formed into a film on a surface of the solder, so that when this base 18 is attached to a socket of lighting equipment (not shown), the eyelet 18*c* and the socket are inappropriately contacted with each other. In addition, corrosion of the eyelet 18C by this flux will cause an inappropriate contact between the eyelet 18C and the socket. Such an inappropriate contact may lead to a lighting failure.

In addition, if plasma arc welding is used to connect the lead wire 17*a* to the eyelet 18*c*, an apparatus for plasma arc welding is expensive and requires a large installation space as well as high costs due to the needs for time and labor required to maintain and manage the apparatus.

The present invention is provided to solve these problems, and it is an object thereof to provide a bulb-form lamp that allows a lighting circuit and an eyelet to be easily and reliably connected together without using any soldering or plasma arc welding or lead wires, that prevents a lighting failure caused by an inappropriate contact, and that requires low costs while providing a high productive efficiency, as well as a method for manufacturing this bulb-form lamp.

SUMMARY OF THE INVENTION

A bulb-form lamp according to the present invention is configured so that a case having a lighting circuit accommodated inside includes a base formed at an end portion thereof and having an eyelet and a screw-like shell and so that the lighting circuit and the eyelet are connected together without any lead wire.

Alternatively, the present invention provides a method for manufacturing a bulb-form lamp in which a case having a lighting circuit accommodated inside includes a base formed at an end portion thereof and having an eyelet and a screw-like shell and in which the eyelet is directly mounted on a printed circuit board of the lighting circuit, the method comprising mounting the eyelet on the printed circuit board of the lighting circuit and then inserting the lighting circuit with the eyelet mounted thereon into the case to fit the eyelet into an eyelet receiving section provided at an end portion of the case.

The above described bulb-form lamp and its manufacturing method enable the lighting circuit and the eyelet to be easily and reliably connected together without using soldering or plasma arc welding or lead wires. In addition, the omission of the soldering or plasma arc welding process serves to improve productive efficiency. Management costs of facilities required for soldering or plasma arc welding and the number of, for example, lead wire materials are also reduced to diminish the total cost. Further, soldering is not particularly required, thereby restraining fluxes to prevent an inappropriate contact between the eyelet and the lighting equipment.

Moreover, the present invention provides a method for manufacturing a bulb-form lamp in which a case having a lighting circuit accommodated inside includes a base formed at an end portion thereof and having an eyelet and a screw-like shell and in which the eyelet shaped like a push pin is connected to a screwless terminal mounted on a printed circuit board of the lighting circuit, the method comprising mounting the screwless terminal on the printed circuit board of the lighting circuit, then inserting the lighting circuit with the screwless terminal mounted thereon into the case for fixture , and then fitting the eyelet into an eyelet receiving section provided at an end portion of the case to connect the eyelet to the screwless terminal.

The above described manufacturing method enables the lighting circuit and the eyelet to be easily and reliably connected together without using soldering or plasma arc welding or lead wires. In addition, the omission of the soldering or plasma arc welding process serves to improve productive efficiency. Management costs of facilities required for the soldering or plasma arc welding process and the number of, for example, lead wire materials are also reduced to diminish the total cost. Further, soldering is not particularly required, thereby restraining fluxes to prevent an inappropriate contact between the eyelet and the lighting equipment. Furthermore, when the base is plugged into the socket and even if the eyelet is pushed toward an interior of the case, a head section of the eyelet comes in abutment with an outer surface of the eyelet receiving section to prevent the eyelet from entering the interior of the case.

DESCRIPTION OF THE EMBODIMENTS

Embodiments of the present invention will be described with reference to the drawings.

Figure 1:
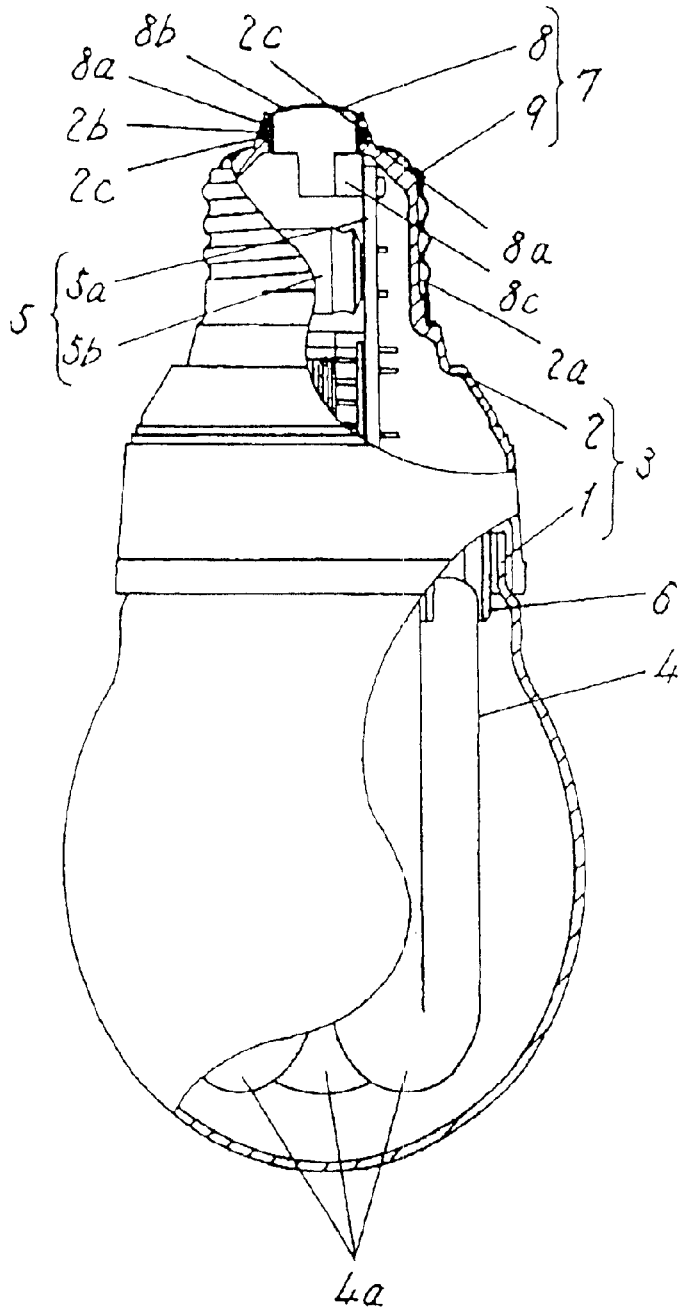
FIG. 1 is a partly cutaway front view of a bulb-form fluorescent lamp according to a first embodiment of the present invention.

A bulb-form fluorescent lamp of rated power 13 W according to a first embodiment of the present invention has a total length of 120 mm and a maximum outer diameter of 60 mm. As shown in FIG. 1, an enclosure 3 comprising a light-transmissive globe 1 and a case 2 of a resin has accommodated therein a fluorescent tube 4 of outer diameter 11 mm comprising three U-shaped tubes 4*a* bridged together to form a single discharge path, a lighting circuit 5 for lighting the fluorescent lamp 4, and a holder 6 for holding an end portion of the fluorescent tube 4 and a lighting circuit 5 located opposite to the fluorescent tube 4.

A base 7 is formed in a cylindrical portion 2*a* of length 25 mm and outer diameter 24 mm provided at an end portion of the case 2. In addition, the cylindrical portion 2*a* of the case 2 has at an end portion thereof an eyelet receiving section 2*b* of inner diameter 10 mm and depth 5 mm into which an eyelet 8, described later, is fitted.

The eyelet receiving section 2*b* has a locked section in an inner surface thereof and in which a locking section 8*a* of the eyelet 8 described below is locked. The locked section 2*c* comprises a recess which is 3 mm in length, 3 mm in breadth, and 1 mm in depth.

The fluorescent tube 4 has electrodes (not shown) at opposite ends thereof. Additionally, the fluorescent tube 4 has predetermined amounts of mercury and rare gas sealed inside.

The lighting circuit 5 comprises a circuit part 5*b* mounted on the printed circuit board 5*a*.

In addition, the printed circuit board 5*a* is located inside the case 2 and parallel with a central axis of the case 2. This enables the eyelet 8 described later to be easily directly mounted on the printed circuit board 5*a*. That is, when the printed circuit board of the lighting circuit is located perpendicularly to the central axis of the case as in the prior art, there is a large gap between the printed circuit board and the eyelet and an auxiliary part is thus required for connecting the printed circuit board and the eyelet together, thereby requiring a time and labor to attach this part. In contrast, by locating the printed circuit board 5*a* parallel with the central axis of the case 2 as in this embodiment, the gap between the printed circuit board 5*a* and the eyelet 8 can be reduced to easily directly mount the eyelet 8 on the printed circuit board 5*a*. Additionally, since the printed circuit board 5*a* can be located within the cylindrical portion 2*a* of the case 2, a space inside the case 2 can be effectively used to reduce the size of the lamp.

The base 7 comprises the eyelet 8 and a screw-like shell 9. The base 7 is screwed, for example, in a socket for an E26 base (not shown).

The eyelet 8 comprises, for example, a nickel-plated copper alloy and is obtained by concavely press-molding a plate of thickness between 0.5 and 1.0 mm. In addition, the eyelet 8 has an outer diameter of 10 mm and a length of 10 mm.

The material of the plate forming the eyelet 8 may be nickel-plated aluminum or stainless steel.

Figure 2:
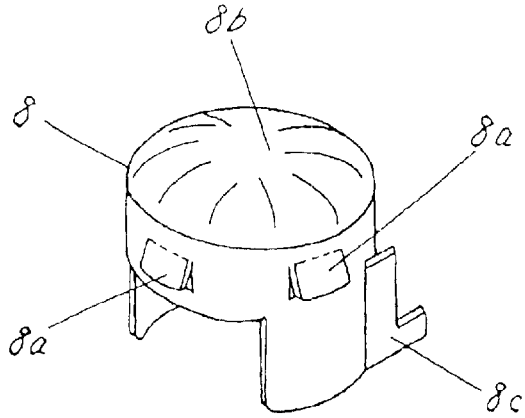
FIG. 2 is similarly an enlarged perspective view of an eyelet used in the bulb-form fluorescent lamp.

As shown in FIG. 2, a head section 8*b* of the eyelet, that is, a portion of the eyelet which is exposed from the case is projected. This ensures an electric contact between the eyelet 8 and a socket of lighting equipment (not shown).

In addition, the eyelet 8 has four locking sections 8a (only two are shown in FIG. 2) formed on a side surface thereof by partly cutting out the side surface in the form of the letter U. Each of the locking sections 8*a* is slightly folded outward from the eyelet 8. Once the eyelet 8 has been fitted into the eyelet receiving section 2*b* to lock the locking sections 8*a* in locked section 2*c* of the eyelet receiving section 2*b* and when the base 7 is plugged into the socket of the lighting equipment (not shown), the eyelet 8 is pushed toward an interior of the case 2 with the lighting circuit 5 so as to be prevented from slipping out from the eyelet receiving section 2*b*, thereby precluding an inappropriate contact between the eyelet 8 and the socket.

Further, the eyelet has an L-shaped terminal section 8*c* provided opposite to the head section 8*b* and which is formed during press molding. The terminal section 8*c* is connected to the printed circuit board 5*a*, as shown in FIG. 1. That is, the eyelet 8 is directly mounted on the lighting circuit 5 so as to be connected thereto without any lead wire.

The shell 9 is fixed by inserting it into the cylindrical portion 2*a* of the case 2 except for a tip portion of the cylindrical portion 2*a* and then caulking it, as shown in FIG. 1 .

An end portion of the cylindrical portion of the case is interposed between the eyelet 8 and the shell 9 as an insulating section. This eliminates the needs for glass as an insulator as in the prior art to thereby reduce costs.

The lighting circuit 5 and the shell 9 are connected together via lead wires (not shown).

Next, a method for manufacturing this bulb-form lamp will be described.

First, a typical method is used to hold the fluorescent tube 4 on the holder 6 by means of an adhesive (not shown). The lighting circuit 5 with the eyelet 8 directly mounted thereon is attached to the holder 6 with the fluorescent tube 4 held thereon in such a manner that the lighting circuit 5 extends perpendicularly from the holder 6.

Next, the integral assembly of the fluorescent tube 4, lighting circuit 5, and holder 6 as well as the case 2 are assembled together so as to house the lighting circuit 5 in the case 2. Simultaneously with this assembly, the eyelet 8 is inserted into the eyelet receiving section 2*b* from an interior of the lamp so as to be fitted therein.

When the eyelet 8 is fitted in the eyelet receiving section 2*b*, the locking sections 8*a* of the eyelet 8 are bent inward of the eyelet 8 due to their eiasticity and is then bent outward of the eyelet 8 at the locked section 2*c*, that is, recovers its original position. The locking sections 8a are thus locked in the locked section 2*c*. Finally, the globe 1 is fixed to the case 2 and the holder 6 by means of an adhesive (not shown). In this manner, the bulb-form fluorescent lamp is manufactured.

According to the above described configuration of the present invention, the lighting circuit 5 and the eyelet 8 can be easily and reliably connected together without using soldering or plasma arc soldering or lead wires. In addition, the omission of the soldering or plasma arc welding process serves to improve productive efficiency. Management costs of facilities required for soldering or plasma arc welding and the number of, for example, lead wire materials are also reduced to diminish the total cost. Further, soldering is not particularly required, thereby preventing a lighting failure caused by an inappropriate contact.

Figure 3:
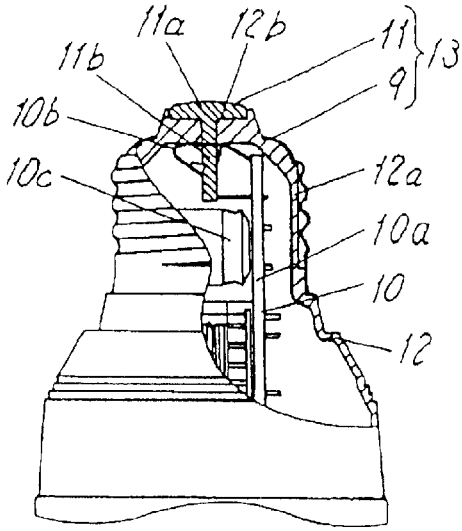
FIG. 3 is an enlarged sectional view of an integral part of a bulb-form fluorescent lamp according to a second embodiment of the present invention.
Figure 4:
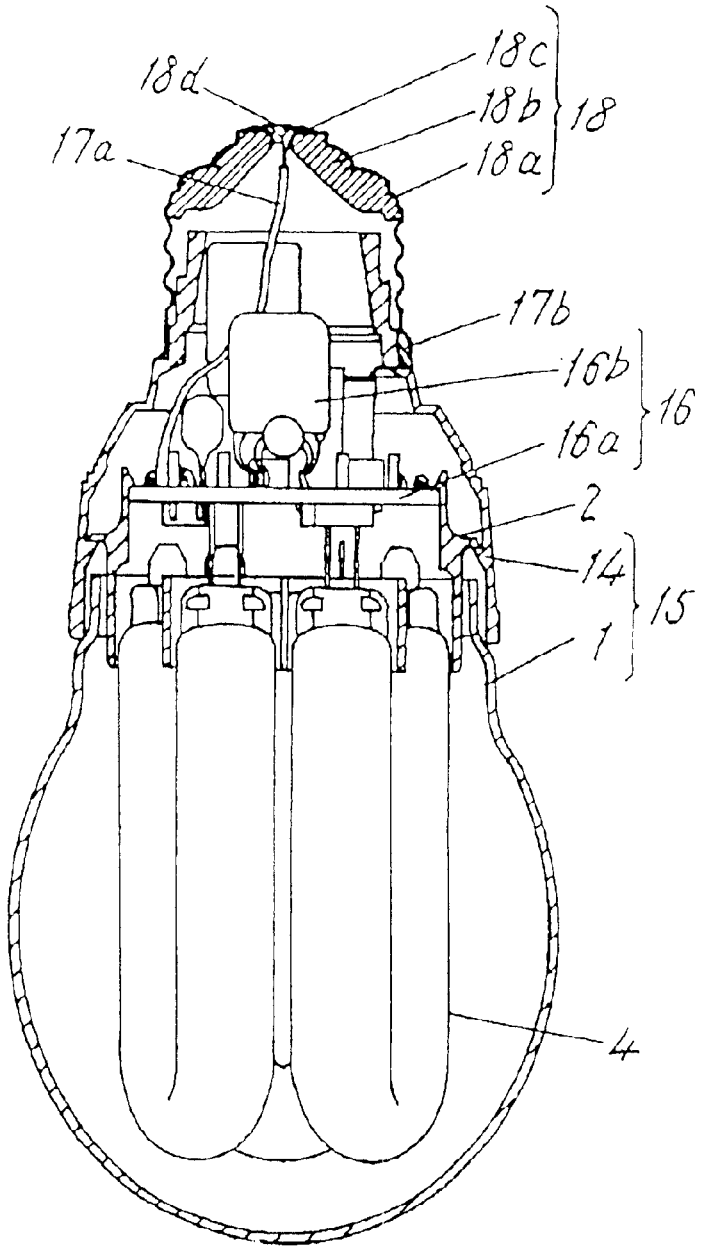
FIG. 4 PRIOR ART
FIG. 4 is a partly cutaway front view of a conventional bulb-form fluorescent lamp.

Next, a bulb-form fluorescent lamp according to a second embodiment of the present invention has the same configuration as the bulb-form fluorescent lamp according to the first embodiment of the present invention except that a screwless terminal 10*b* is mounted on a printed circuit board 10*a* of a lighting circuit 10, that a push-pin-shaped eyelet 11 is fitted in an eyelet receiving section 12*b* provided in a cylindrical portion 12*a* of a case 12, and that the eyelet 11 is inserted into the screwless terminal 10*b*, as shown in FIG. 3.

In FIG. 3, reference numeral 9 denotes a shell, reference numeral 10*c* denotes a lighting part, and reference numeral 13 denotes a base.

The eyelet 11 is made, for example, of a nickel-plated copper alloy and comprises a head section 11*a* of outer diameter 10 mm and thickness 2 mm and a pin section 11*b* of outer diameter 1.5 mm and length 10 mm. The pin 11*b* is electrically connected to the screwless terminal 10*b*. The screwless terminal 10*b* also prevents the pin lib from slipping out therefrom.

In this bulb-form fluorescent lamp, the lighting circuit 10 and the eyelet 11 are connected without any lead wire.

Next, a method for manufacturing this bulb-form lamp will be described.

First, a typical method is used to hold the fluorescent tube 4 on a holder (not shown) by means of an adhesive (not shown). The lighting circuit 10 with the screwless terminal 10*b* mounted thereon is attached to the holder with the fluorescent tube 4 held thereon in such a manner that the lighting circuit 10 extends perpendicularly from the holder.

Next, the integral assembly of the fluorescent tube 4, lighting circuit 10, and holder as well as the case 12 are assembled together so as to house the lighting circuit 10 in the case 12.

Then, the eyelet 11 is inserted into the eyelet receiving section 12*b* of the case 12 from an exterior of the lamp so as to be fitted therein. Simultaneously with this fitting, the eyelet 11 is connected to the screwless terminal 10*b*. Finally, the globe 1 is fixed to the case 2 and the holder 6 by means of an adhesive (not shown). In this manner, the bulb-form fluorescent lamp is manufactured.

According to the above described configuration of the present invention, not only the effects of the above described first embodiment of the present invention but also the following effect is obtained: when the base 13 is plugged into a socket and even if the eyelet is pushed toward an interior of the case 12, the head section 11*a* of the eyelet 11 comes in abutment with an outer surface of the eyelet receiving section 12*b*, thereby preventing the eyelet 11 from entering the interior of the case 12. As a result, an inappropriate contact between the eyelet 8 and the socket is prevented.

Although the above embodiments have been described in connection with the bulb-form fluorescent lamps, the present invention is not limited to this but provides similar effects with incandescent lamps, reflector lamps, and high-voltage discharge lamps.

What is claimed:

1. A bulb-form lamp, comprising:

a case containing a lighting circuit and having a base attached at an end portion of the case;

a screw-like shell attached to the base;

an eyelet located in the screw-like shell and directly connected, without any lead wire, to said lighting circuit.

2. The bulb-form lamp according to claim 1, wherein said eyelet is directly mounted on a printed circuit board of said lighting circuit.

3. The bulb-form lamp according to claim 2, wherein said eyelet has locking sections located on a side surface thereof, and said case has a locked section located in an inner surface of an end portion thereof and in which said locking sections are locked.

4. The bulb-form lamp according to claim 2, wherein said eyelet comprises a concavely press-molded plate.

5. The bulb-form lamp according to claim 1, further comprises a screwless terminal mounted on a printed circuit board and connected to said lighting circuit, wherein said eyelet comprises a push pin and is slidingly engaged with and connected to said screwless terminal for preventing said eyelet from detaching from the printed circuit board.

6. The bulb-form lamp according to claim 1, wherein part of said case is an insulating section for mutually insulating said eyelet and said shell.

7. The bulb-form lamp according to claim 1, wherein a head section of said eyelet is projected with respect to an exterior of the bulb-form of lamp.

8. The bulb-form lamp according to claim 1, wherein said lighting circuit has a printed circuit board located inside said case and parallel with a central axis of said case.

9. A method for manufacturing a bulb-form lamp in which a case having a lighting circuit located inside includes a base formed at an end portion thereof and having an eyelet and a screw-like shell and in which said eyelet is directly mounted on a printed circuit board of said lighting circuit, comprising:

mounting said eyelet directly on the printed circuit board of said lighting circuit, without a lead wire; and inserting said lighting circuit with said eyelet mounted thereon into said case, whereby said eyelet is located in said shell and fitted into an eyelet receiving section provided at an end portion of said case.

10. A method for manufacturing a bulb-form lamp in which a case having a lighting circuit accommodated inside includes a base formed at an end portion thereof and having an eyelet and a screw-like shell and in which said eyelet shaped like a push pin is connected to a screwless terminal mounted on a printed circuit board of said lighting circuit:

mounting said screwless terminal on the printed circuit board of said lighting circuit;

inserting said lighting circuit with said screwless terminal mounted thereon into said case for fixture; and then fitting said eyelet into an eyelet receiving section provided at an end portion of said case, whereby said eyelet is slidingly engaged with and connected to said screwless terminal.

* * * * *